US007934481B2

(12) United States Patent
Zingelmann

(10) Patent No.: US 7,934,481 B2
(45) Date of Patent: May 3, 2011

(54) FLYWHEEL STARTER PULLEY ATTACHMENT APPARATUSES AND METHODS

(75) Inventor: Christopher Kurt Zingelmann, Carrboro, NC (US)

(73) Assignee: Honda Motor Co., Ltd., Tokyo (JP)

( * ) Notice: Subject to any disclaimer, the term of this patent is extended or adjusted under 35 U.S.C. 154(b) by 554 days.

(21) Appl. No.: 12/047,814

(22) Filed: Mar. 13, 2008

(65) Prior Publication Data

US 2009/0229558 A1 Sep. 17, 2009

(51) Int. Cl.
*F02N 1/00* (2006.01)
*F02N 3/02* (2006.01)

(52) U.S. Cl. ..... 123/185.2; 123/185.3

(58) Field of Classification Search ..... 123/185.2, 123/185.3; 411/908, 512

See application file for complete search history.

(56) References Cited

U.S. PATENT DOCUMENTS

| | | | | |
|---|---|---|---|---|
| 3,952,712 | A | 4/1976 | Hermanson | |
| 4,838,762 | A | 6/1989 | Savage et al. | |
| 5,211,144 | A | 5/1993 | Collins et al. | |
| 5,336,050 | A * | 8/1994 | Guida et al. | 416/186 R |
| 6,006,703 | A | 12/1999 | Nakamura et al. | |
| 7,225,765 | B2 * | 6/2007 | Leech et al. | 123/41.7 |
| 2006/0288970 | A1 | 12/2006 | Miyake et al. | |

FOREIGN PATENT DOCUMENTS

| | | |
|---|---|---|
| DE | 1957988 | 6/1971 |
| GB | 2041102 | 9/1980 |
| JP | 59-62225 | 4/1984 |
| JP | 9250348 | 9/1997 |

* cited by examiner

*Primary Examiner* — Stephen K Cronin
*Assistant Examiner* — Arnold Castro
(74) *Attorney, Agent, or Firm* — Jenkins, Wilson, Taylor & Hunt, P.A.

(57) ABSTRACT

Flywheel starter pulley attachment apparatuses and methods are disclosed for a flywheel rotatable about an axis and a starter pulley rotatable about the same axis as the flywheel. One or more retainers can be provided to couple rotation of the starter pulley to the flywheel and/or a cooling fan element attached thereto. Each of the retainers can be configured for at least a portion of the retainer to pass through an opening in the starter pulley. Each retainer can include a body portion and a fin portion, the fin portion extending outwardly from the body portion. The fin portion can further include a protruding lip disposed between first and second edges of the fin portion, for example, forming an angle of from about 100° to about 180°. The protruding lip can be configured to engage the starter pulley when the retainer is positioned through the opening of the starter pulley to secure the starter pulley in place where rotational movement of the flywheel assembly can occur in either direction. Holes can be defined in the cooling fan element that can correspond in shape to the shape of the fin portion of each retainer.

19 Claims, 7 Drawing Sheets

FLYWHEEL STARTER PULLEY ATTACHMENT APPARATUSES AND METHODS

TECHNICAL FIELD

The subject matter disclosed herein relates generally to motors and flywheels used in association therewith. More particularly, the subject matter disclosed herein relates to apparatuses and methods for coupling the rotation of a starter pulley to the rotation of a flywheel.

BACKGROUND

Pull-start internal combustion engines are commonly used in equipment such as lawnmowers, snowblowers, leaf blowers, and the like. The typical starter mechanism for these types of engines can include a starter pulley driven by a pull rope, the starter pulley then being coupled to a flywheel. As the pull cord is drawn, the starter pulley is rotated, thereby rotating the flywheel. The energy accrued in the flywheel is transferred to the driveshaft of the engine, giving it the rotational energy needed to start the engine.

To ensure the power is transferred efficiently, the components should be securely coupled to each other, and there are a number of ways that a starter pulley and a flywheel can be coupled together. For instance, some flywheel assemblies are coupled using upwardly-facing pins on the flywheel and mating holes on the starter pulley. In these configurations, the two pieces can be connected together and then assembled onto the engine. The problem with this kind of coupling arrangement is that there is nothing to fix the two pieces to each other. Alternatively, the coupling of these elements can be accomplished using bolts or other similar fasteners. Although such fasteners provide more secure coupling, however, their use adds additional time and work during assembly.

Therefore, improved attachment apparatuses and methods are needed for coupling the rotation of a starter pulley to a flywheel.

SUMMARY

In accordance with this disclosure, novel flywheel starter pulley attachment apparatuses and methods are provided. It is therefore an object of the present disclosure to provide novel flywheel starter pulley attachment apparatuses and methods that provide secure attachment of a starter pulley to a flywheel, or where the flywheel has an attached cooling fan element, to the cooling fan element. It is a further object of the present disclosure that such apparatuses be readily assembled. These and other objects as may become apparent from the present disclosure are achieved, at least in whole or in part, by the subject matter described herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

Figure 1:
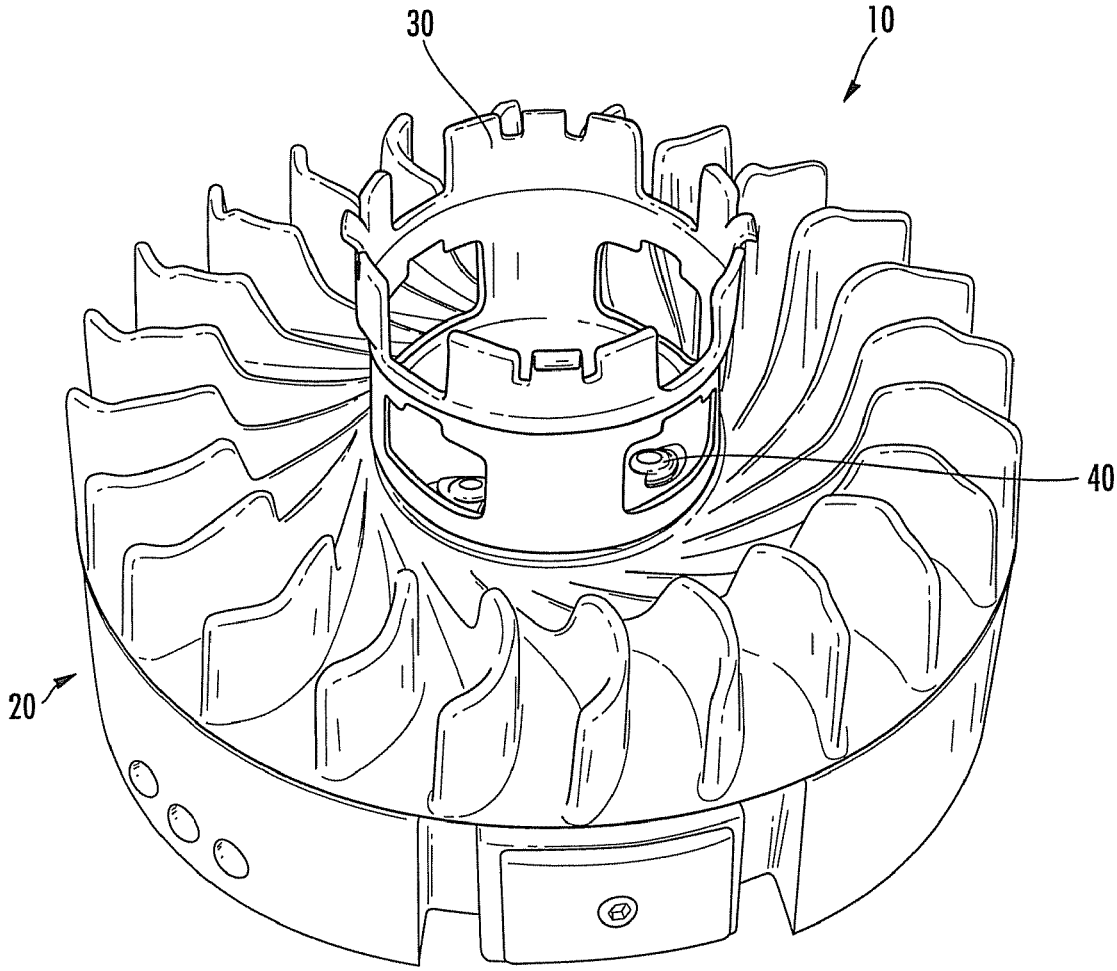
FIG. 1 of the drawings is a perspective view of a starter pulley attached to a flywheel illustrating use of an embodiment of a flywheel starter attachment apparatus according to the present subject matter.

FIG. 1 illustrates a flywheel assembly, generally designated 10, that can be used in association with an internal combustion engine. The assembly can include a flywheel generally designated 20 and a starter pulley 30. Flywheel 20 can also include an integral or a detachable cooling fan such as cooling fan element 26 having a series of fan blades 28. Cooling fan blades 28 can be operable to generate airflow within the engine during the rotation of flywheel assembly 10. Alternatively, cooling fan blades 28 can be integrated onto a surface of flywheel 20. This alternative configuration can also provide cooling to the rotating engine, but with fewer individual elements that need to be assembled together.

Figure 2:
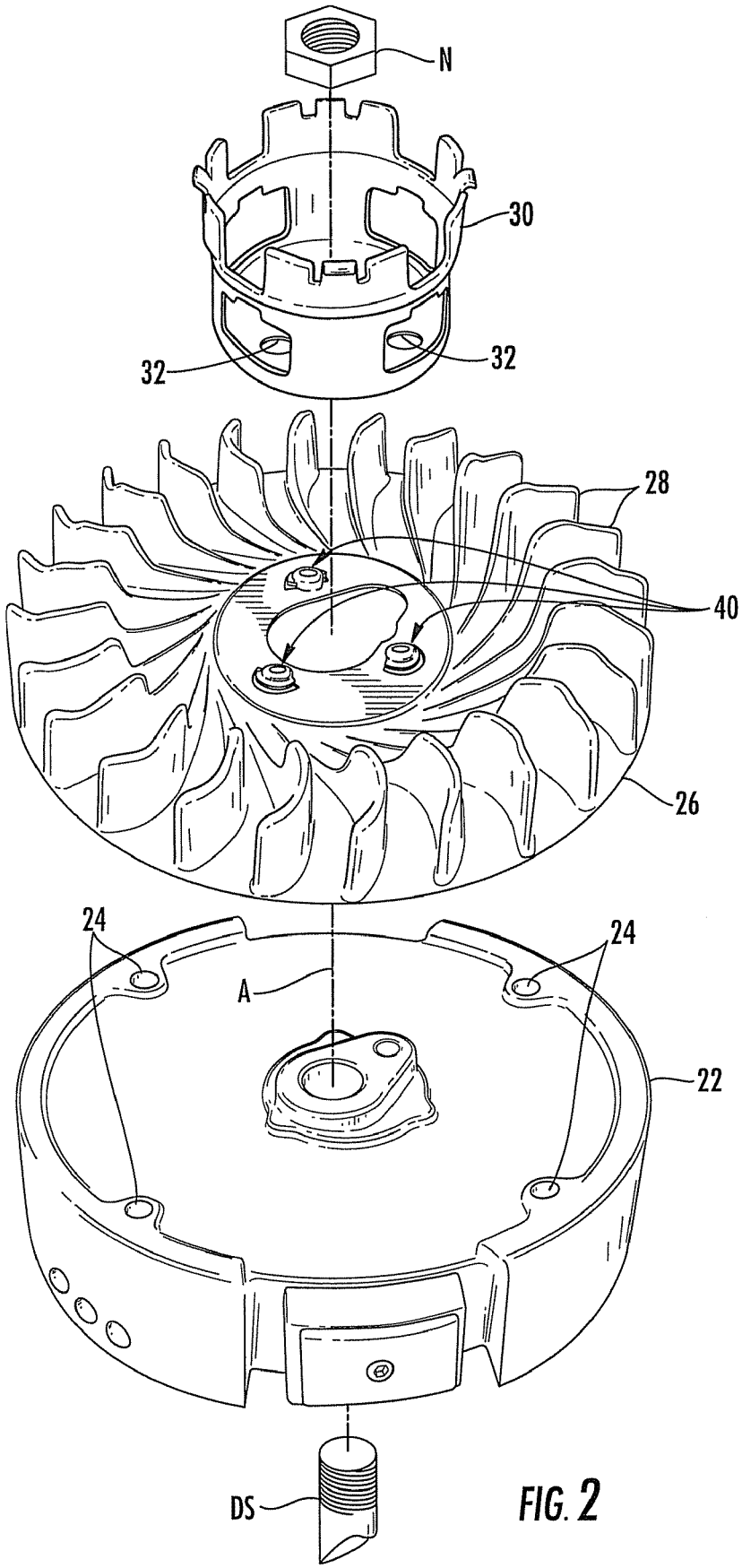
FIG. 2 of the drawings is an exploded perspective view of an embodiment of a flywheel starter pulley attachment apparatus according to the present subject matter.

Referring to the exploded view of FIG. 2, an embodiment of the flywheel assembly is shown where a separable cooling fan element 26 can be attached to a flywheel base 22, such as by any suitable fasteners (not shown) extending from cooling fan element 26 and into receiving areas such as holes 24 of flywheel base 22. As noted above, it is desirable for the elements of the flywheel assembly to be securely coupled together and rotatable about a single axis A of rotation to ensure that the rotational energy imparted on starter pulley 30 is efficiently transferred to the flywheel, which in FIG. 2 is shown as flywheel base 22. Cooling fan element 26, starter pulley 30, and flywheel base 22 can be concentrically assembled along axis A where each component can be disposed on a shaft such as a drive shaft DS with a fastener such as a nut N securing the assembly together. Starter pulley 30 can include one or more openings such as openings 32 that can be defined in the planar surface of starter pulley 30 that is to be coupled to cooling fan element 26. These openings 32 can correspond to one or more retainers generally designated 40 on cooling fan element 26. For example, in the embodiment shown in FIG. 2, three retainers 40 can be included on cooling fan element 26 and positioned around axis A in an equally spaced-apart manner as shown. At least a portion of each of the retainers 40 can be configured to pass through a corresponding one of openings 32 to secure the elements together and thereby couple the rotation of starter pulley 30 to cooling fan element 26 and therefore to flywheel base 22 due to the attachment of cooling fan element 26 to flywheel base 22.

Figure 3A:
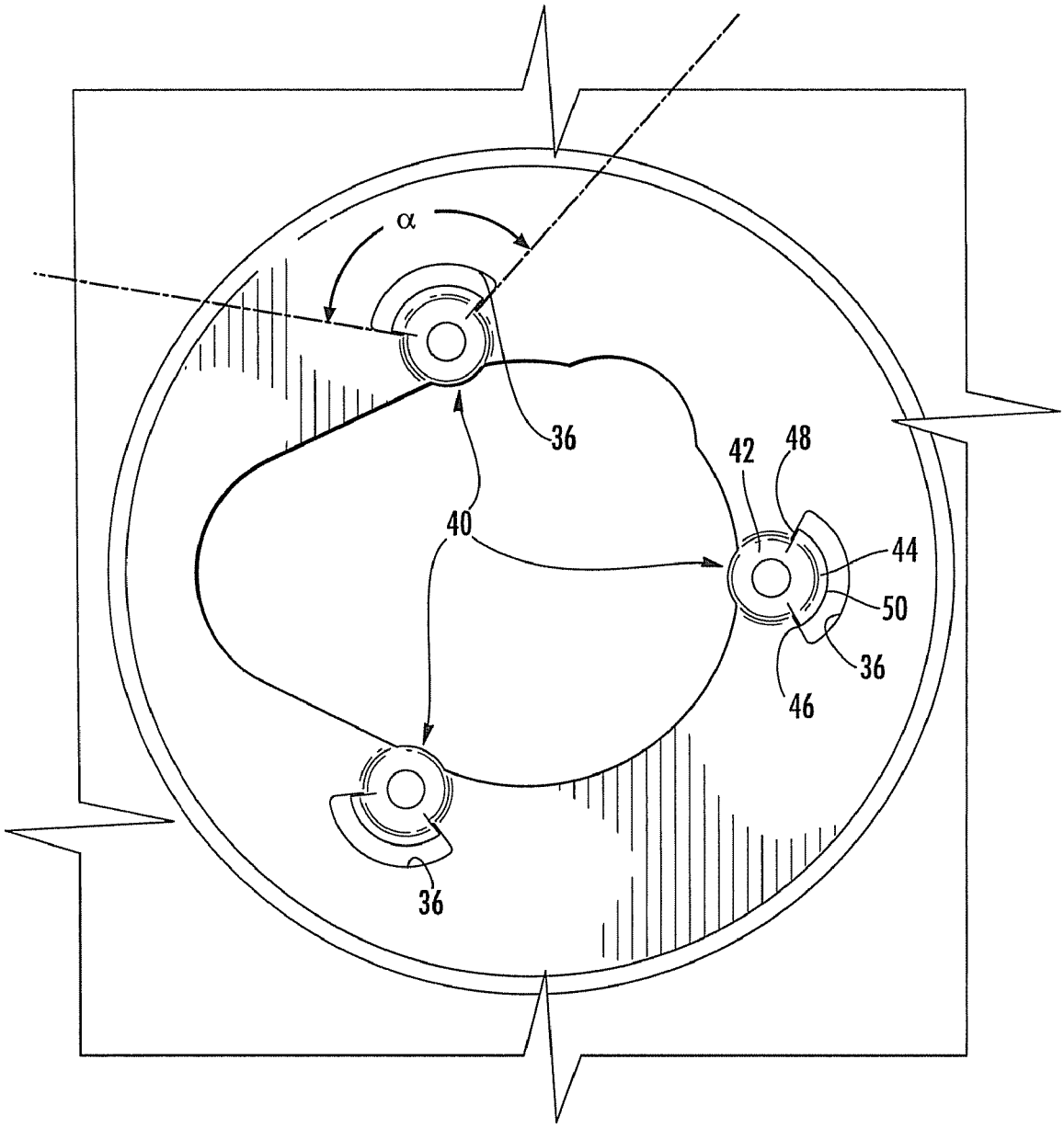
FIG. 3A of the drawings is a top plan view of a portion of a cooling fan illustrating an embodiment of retainers thereon according to the present subject matter.
Figure 3B:
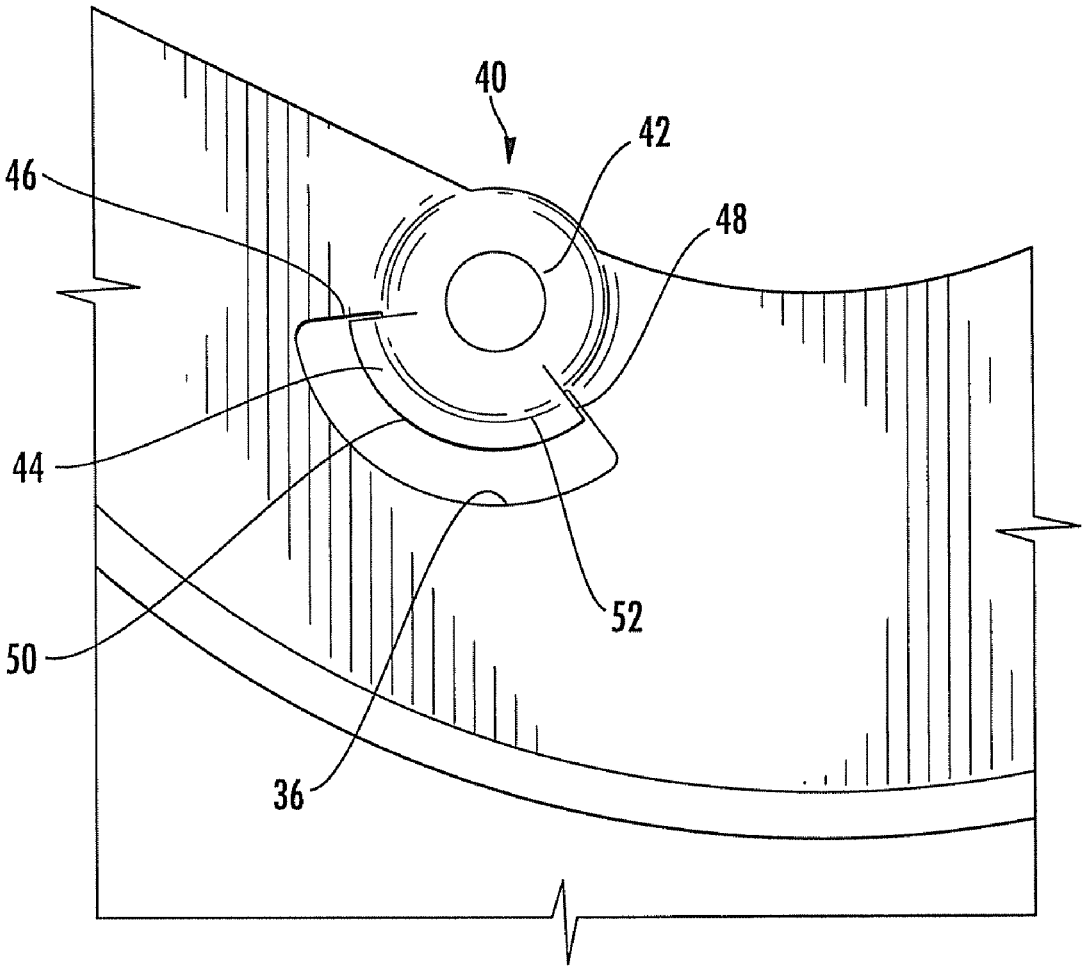
FIG. 3B of the drawings is a close-up, top plan view illustrating a single retainer from FIG. 3A.

FIGS. 3A and 3B provide more detailed views of retainer 40. As illustrated, each of retainers 40 can include a body portion 42 and a fin portion 44, where fin portion 44 can extend outwardly from all or a portion of body portion 42. When viewed from above as shown in FIGS. 3A and 3B, fin portion 44 can have a substantially fan-shaped outline. In particular, fin portion 44 can have first and second edges 46 and 48, with the fan-shaped surface between them sweeping an arc over about a sufficiently wide angle. This surface can form a protruding lip 50 that can be configured to engage starter pulley 30 when retainer 40 is positioned through opening 32 of starter pulley 30 to secure starter pulley 30 to cooling fan element 26 and flywheel base 22. For instance, as shown in FIGS. 3A and 3B, first and second edges 46 and 48 can form an angle $\alpha$ of from about 100° to about 180°, or more specifically of about 120° such that lip 50 is disposed at any such angle along a curve. Of course, a larger fin portion 44 can more securely hold the components together because protruding lip 50 can engage starter pulley 30 over a greater span. In contrast, a smaller fin portion 44 can be more easily assembled. Accordingly, the extent of extension of fin portion 44 from body portion 42 can vary as needed, and the angle between first and second edges 46 and 48 and thus the size of each fin portion 44 can be selected to balance these factors.

Figure 4:
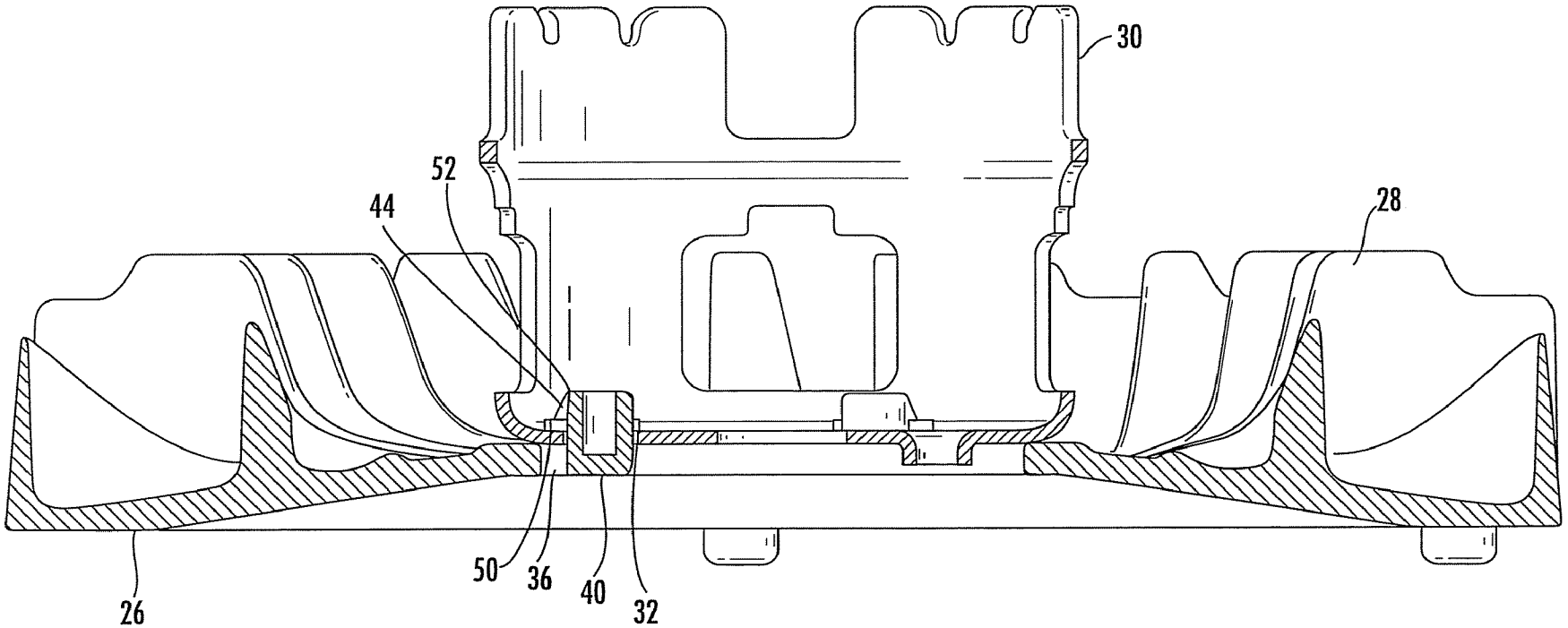
FIG. 4 of the drawings is a side sectional view of an embodiment of a flywheel starter pulley attachment apparatus according to the present subject matter.

Advantageously, fin portion 44 on each of the retainers 40 can be tapered from the top to the bottom from a leading edge 52, as perhaps best illustrated in FIGS. 3B and 4, to facilitate insertion of each of retainers 40 through one of openings 32 in starter pulley 30. Stated otherwise, where a retainer 40 is provided as a substantially cylindrical structure and a corresponding opening 32 is a substantially circular hole, for example, the diameter of retainer 40 at leading edge 52 can be at most equal to the diameter of opening 32. As a retainer 40 is passed through opening 32, however, the effective diameter of retainer 40 widens as a result of the increasing extension of fin portion 44. Fin portion 44 or any other suitable portion of retainer 40 can be deformable such that it can be pushed or snapped through opening 32 in spite of its increasing diameter, but once fin portion 44 passes through opening 32, protruding lip 50 can extend over the top edge of opening 32 as shown in FIG. 4 where lip 50 sits directly on top of a portion of a portion of starter pulley 30. As a result, retainer 40 is prevented from being pulled back through opening 32. In this manner, flywheel base 22, cooling fan element 26, and starter pulley 30 can be securely coupled by aligning retainers 40 with openings 32 and snapping the pieces together. This quick assembly can save valuable resources in the manufacture of a flywheel assembly.

In addition to the above, one or more holes such as holes 36 illustrated in FIGS. 1-4 can be defined by and entirely through cooling fan element 26 where each of holes 36 can be disposed beneath protruding lip 50 on fin portion 44 of retainer 40. Holes 36 can be of any suitable shape and size, and can be of a shape corresponding at least similarly to the shape of each fin portion 44 of each of retainers 40. As such, holes 36 can be defined between opposing inner edges of each of holes 36 of cooling fan element 26 where the inner edges can form an angle $\alpha$ of from about 100° to about 180°, and can also be an angle of about 120°. Holes 36 can assist in reducing weight of cooling fan element 26 and can be useful during manufacturing in that a forming tool can be positioned within holes 36 during manufacturing.

Referring again to FIGS. 3A and 3B, in one configuration fin portion 44 of each of retainers 40 can extend from a side of each retainer 40 in a direction away from the common axis of rotation of flywheel 20 and starter pulley 30, which is axis A shown in FIG. 2. In this configuration, each of retainers 40 engage starter pulley 30 in a direction generally perpendicular to the direction of motion of starter pulley 30 regardless of the direction of rotation. Retainer 40 oriented in this way can provide secure coupling of starter pulley 30 as described herein regardless of whether the flywheel assembly is rotated clockwise or counterclockwise.

Figure 5:
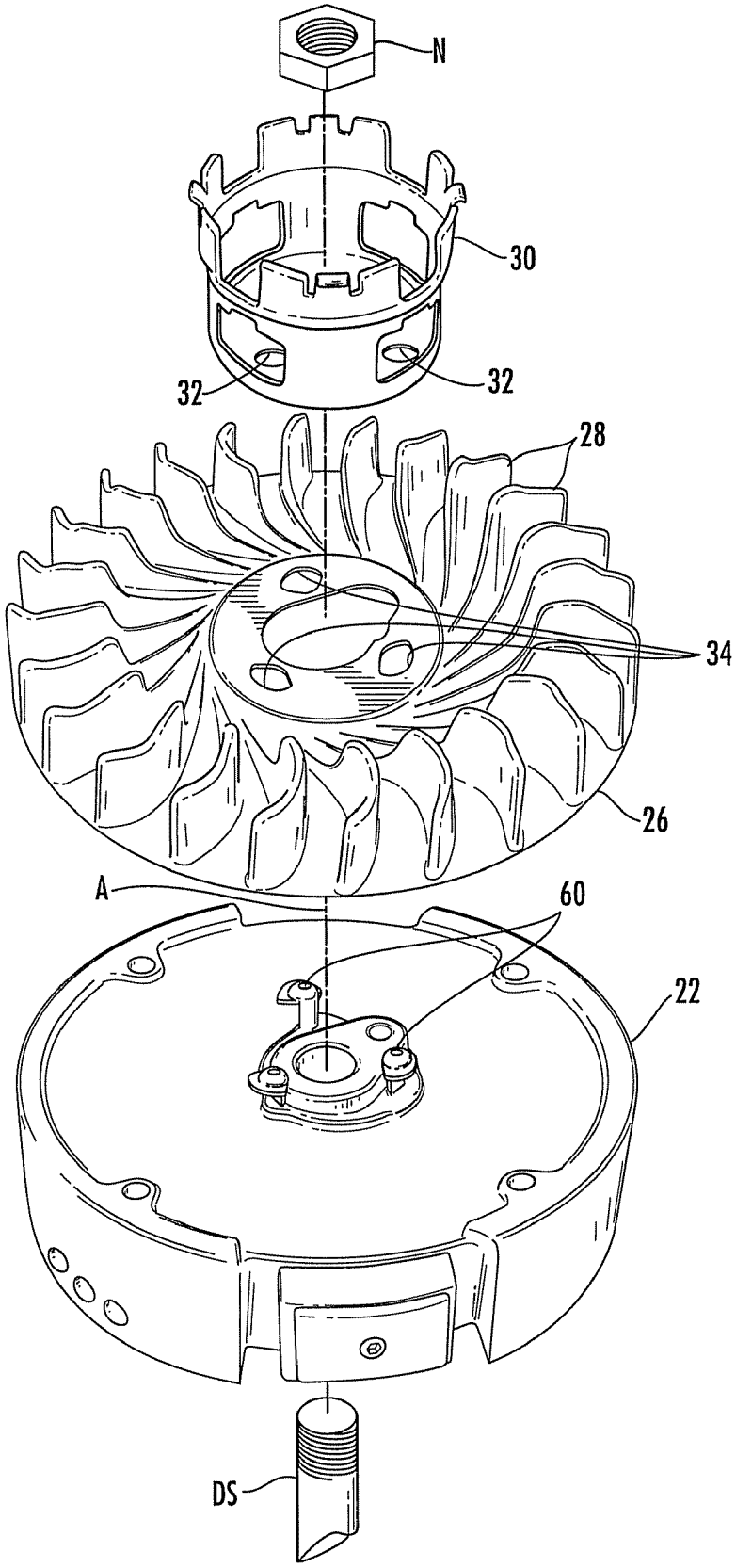
FIG. 5 of the drawings is an exploded perspective view illustrating another embodiment of a flywheel starter pulley attachment apparatus according to the present subject matter.
Figure 6:
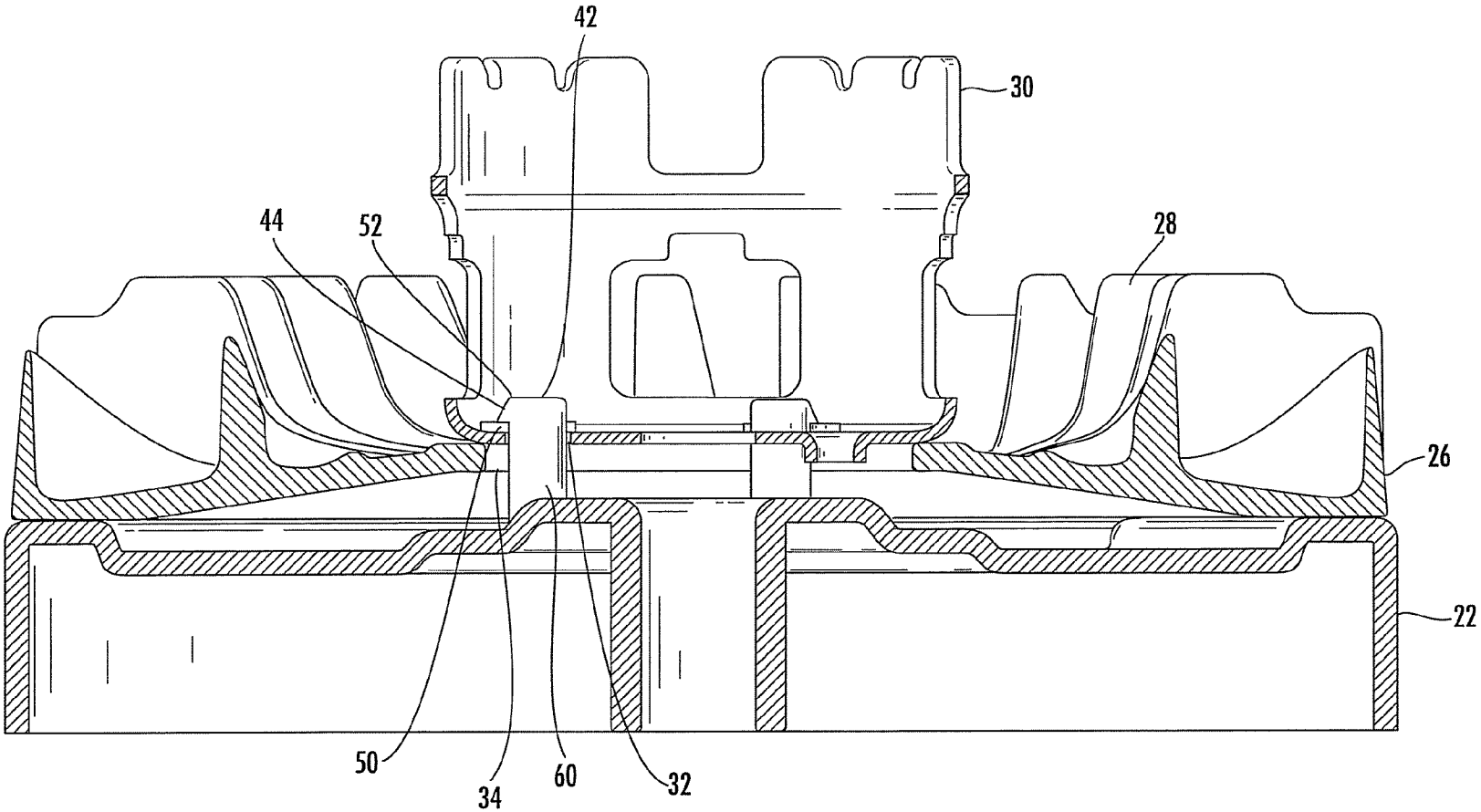
FIG. 6 of the drawings is a side sectional view of the embodiment shown in FIG. 5.

FIGS. 5 and 6 illustrate another embodiment of a flywheel and starter assembly according to the present subject matter where common parts are represented by the same references from the above description. In this configuration, however, cooling fan element 26 can include one or more openings such as openings 34 instead of having retainers thereon. Each of openings 34 can correspond to one of openings 32 in starter pulley 30. Flywheel base 22 can instead have elongated retainers such as retainers 60 with at least a portion of each retainer 60 configured to pass through one of corresponding openings 34 in cooling fan element 26 and one of corresponding openings 32 in starter pulley 30. Other than being suitably elongated from bottom to top for appropriate extension through cooling fan element holes 34 and starter pulley holes 32, the remaining structure of retainers 60 can be identical to retainers 40 described above. Once each one of one or more of retainers 60 is at least partially inserted through openings 34 and 32, protruding lip 50 can engage and hold in place starter pulley 30. In this way, retainers 60 again serve to couple flywheel base 22, cooling fan element 26, and starter pulley 30 together for rotational movement in either direction about concentric rotational axis A.

Embodiments of the present disclosure shown in the drawings and described above are exemplary of numerous embodiments that can be made within the scope of the appending claims. It is contemplated that the configurations described herein can comprise numerous configurations other than those specifically disclosed. The scope of a patent issuing from this disclosure will be defined by these appending claims.

What is claimed is:

1. A flywheel starter pulley attachment apparatus comprising:

a flywheel rotatable about an axis;

a starter pulley for coupling with the flywheel and being rotatable about the same axis as the flywheel, the starter pulley having at least one opening; and a retainer on the flywheel for coupling rotation of the starter pulley to the flywheel, the retainer configured for at least a portion of the retainer to pass through the opening of the starter pulley, and the retainer comprising a body portion and a fin portion, the fin portion extending outwardly from the body portion, the fin portion having first and second edges forming an angle of from about 100° to about 180°, and the fin portion having a protruding lip configured to engage the starter pulley when the retainer is positioned through the opening of the starter pulley to secure the starter pulley to the flywheel.

2. The apparatus of claim 1, wherein the fin portion extends from a side of the retainer in a direction away from the axis of rotation of the flywheel and starter pulley.

3. The apparatus of claim 1, wherein the flywheel comprises cooling fan blades extending from a surface of the flywheel.

4. The apparatus of claim 1, wherein the flywheel comprises a flywheel base and a separable cooling fan element positioned between the flywheel base and the starter pulley.

5. The apparatus of claim 4, wherein the cooling fan element is secured to the flywheel base, the retainer is on the cooling fan element, and the retainer is configured to pass through the opening of the starter pulley to couple the starter pulley to the cooling fan element and the flywheel base.

6. The apparatus of claim 4, wherein the cooling fan element comprises at least one opening corresponding to the at least one opening in the starter pulley, the retainer is on the flywheel base, and the retainer is configured to pass through corresponding openings in the cooling fan element and the starter pulley to couple the starter pulley to the cooling fan element and the flywheel base.

7. The apparatus of claim 4, wherein the cooling fan element comprises one or more holes in the cooling fan element disposed beneath the fin portion of the retainer.

8. The apparatus of claim 7, wherein the one or more holes in the cooling fan element correspond at least partially in shape to a shape of the fin portion of the retainer.

9. The apparatus of claim 1, wherein the fin portion on the retainer is tapered from a top of the fin portion to a bottom of the fin portion.

10. The apparatus of claim 1, wherein the fin portion is disposed along a curve between the first and second edges, with the first and second edges forming an angle of about 120°.

11. The apparatus of claim 1, comprising a plurality of retainers on the flywheel for coupling rotation of the starter pulley to the flywheel.

12. A flywheel starter pulley attachment apparatus comprising:

a flywheel rotatable about an axis;

a starter pulley for coupling with the flywheel and being rotatable about the same axis as the flywheel, the starter pulley having a plurality of openings; and a plurality of retainers on the flywheel for coupling rotation of the starter pulley to the flywheel, each of the plurality of retainers configured for at least a portion of the retainer to pass through one of the plurality of openings of the starter pulley, and each retainer comprising a body portion and a fin portion, each fin portion extending outwardly from the body portion on a side of the retainer in a direction away from the axis of rotation of the flywheel and starter pulley, the fin portion having first and second edges forming an angle of from about 100° to about 180°, and the fin portion having a protruding lip configured to engage the starter pulley when the retainer is positioned through the opening of the starter pulley to secure the starter pulley to the flywheel.

13. A method for coupling a starter pulley to a flywheel, comprising:

providing a flywheel rotatable about an axis;

providing a starter pulley for coupling with the flywheel and being rotatable about the same axis as the flywheel, the starter pulley having at least one opening;

providing a retainer on the flywheel for coupling rotation of the starter pulley to the flywheel, the retainer comprising a body portion and a fin portion, the fin portion extending outwardly from the body portion, the fin portion having first and second edges forming an angle of from about 100° to about 180°, and the fin portion having a protruding lip; and inserting at least a portion of the retainer through the opening in the starter pulley where the protruding lip on the fin portion of the retainer engages the starter pulley to secure the starter pulley to the flywheel.

14. A method for coupling a starter pulley to a flywheel, comprising:

providing a flywheel rotatable about an axis;

providing a starter pulley for coupling with the flywheel and being rotatable about the same axis as the flywheel, the starter pulley having a plurality of openings;

providing a plurality of retainers on the flywheel for coupling rotation of the starter pulley to the flywheel, each of the retainers comprising a body portion and a fin portion, each fin portion extending outwardly from the body portion and each fin portion having first and second edges forming an angle of about 120°, and each fin portion having a protruding lip; and inserting at least a portion of each of the retainers through the openings in the starter pulley where the protruding lip on each fin portion of each of the retainers engages the starter pulley to secure the starter pulley to the flywheel.

15. A flywheel starter pulley attachment apparatus comprising:

a flywheel rotatable about an axis;

a starter pulley for coupling with the flywheel and being rotatable about the same axis as the flywheel, the starter pulley having at least one opening;

a cooling fan element for coupling with the starter pulley; and a retainer on the cooling fan element for coupling rotation of the starter pulley to the flywheel, the retainer configured for at least a portion of the retainer to pass through the opening of the starter pulley, and the retainer comprising a body portion and a fin portion, the fin portion extending outwardly from the body portion, and the fin portion having a protruding lip configured to engage the starter pulley when the retainer is positioned through the opening of the starter pulley to secure the starter pulley to the flywheel;

wherein the cooling fan element comprises a hole through the cooling fan element beneath the fin portion; and wherein the fin portion having first and second edges, and wherein the fin portion is disposed along a curve between the first and second edges, with the first and second edges forming an angle of from about 100° to about 180°.

16. A flywheel starter pulley attachment apparatus comprising:

a flywheel rotatable about an axis;

a starter pulley for coupling with the flywheel and being rotatable about the same axis as the flywheel, the starter pulley having at least one opening;

a cooling fan element for coupling with the starter pulley; and a retainer on the cooling fan element for coupling rotation of the starter pulley to the flywheel, the retainer configured for at least a portion of the retainer to pass through the opening of the starter pulley, and the retainer comprising a body portion and a fin portion, the fin portion extending outwardly from the body portion with the fin portion extending from a side of the retainer in a direction away from the axis of rotation of the flywheel and starter pulley, and the fin portion having a protruding lip configured to engage the starter pulley when the retainer is positioned through the opening of the starter pulley to secure the starter pulley to the flywheel;

wherein the cooling fan element comprises a hole through the cooling fan element beneath the fin portion.

17. The apparatus of claim 16, wherein the hole in the cooling fan element corresponds at least partially in shape to a shape of the fin portion of the retainer.

18. The apparatus of claim 15, wherein the fin portion on the retainer is tapered from a top of the fin portion to a bottom of the fin portion.

19. The apparatus of claim 16, comprising a plurality of retainers on the flywheel for coupling rotation of the starter pulley to the flywheel.

* * * * *